US010390578B2

(12) United States Patent
Kuo et al.

(10) Patent No.: US 10,390,578 B2
(45) Date of Patent: Aug. 27, 2019

(54) GUARD PADDING WITH SENSOR AND PROTECTIVE GEAR INCLUDING THE SAME

(71) Applicant: NATIONAL TSING HUA UNIVERSITY, Hsinchu (TW)

(72) Inventors: Chia-Chen Kuo, Hsinchu (TW); Mao-Jiun Wang, Hsinchu (TW); Chun Zhang, Marietta, GA (US); Hsu-Pin Wang, Atlanta, GA (US); Kan Wang, Marietta, GA (US)

(73) Assignee: National Tsing Hua University, Hsinchu (TW)

( * ) Notice: Subject to any disclaimer, the term of this patent is extended or adjusted under 35 U.S.C. 154(b) by 390 days.

(21) Appl. No.: 15/189,834

(22) Filed: Jun. 22, 2016

(65) Prior Publication Data

US 2017/0273386 A1 Sep. 28, 2017

(30) Foreign Application Priority Data

Mar. 23, 2016 (TW) ..... 105109091 A

(51) Int. Cl.
*A42B 3/04* (2006.01)
*A42B 3/12* (2006.01)

(52) U.S. Cl.
CPC ..... *A42B 3/0433* (2013.01); *A42B 3/046* (2013.01); *A42B 3/0466* (2013.01); *A42B 3/12* (2013.01); *A42B 3/127* (2013.01)

(58) Field of Classification Search
CPC ..... A42B 3/0433; A42B 3/046; A42B 3/0466; A42B 3/12; A42B 3/127; A42B 3/04; A42B 3/044; A42B 3/0406; A42B 3/00
USPC ..... 2/455, 414, 410
See application file for complete search history.

(56) References Cited

U.S. PATENT DOCUMENTS 7,128,434 B1 * 10/2006 Nally ..... A42B 3/044 362/105
7,526,389 B2 * 4/2009 Greenwald ..... A42B 3/046 2/425
8,517,963 B2 * 8/2013 Larson ..... A61B 17/1325 602/13
8,539,815 B2 * 9/2013 Jeftic-Stojanovski ..... A42B 3/046 73/12.04
8,797,165 B2 * 8/2014 Greenwald ..... A61B 5/0002 340/573.1
9,247,780 B2 * 2/2016 Iuliano ..... A42B 3/046
2009/0199317 A1 * 8/2009 Schwiers ..... A42B 3/0433 2/5
2011/0218756 A1 * 9/2011 Callsen ..... F41H 1/04 702/139
2011/0219852 A1 * 9/2011 Kasten ..... A61B 5/11 73/12.04

(Continued)

*Primary Examiner* — Anna K Kinsaul
*Assistant Examiner* — F Griffin Hall
(74) *Attorney, Agent, or Firm* — Wang Law Firm, Inc.

(57) ABSTRACT

Guard padding with sensor is provided, including a cushion pad and a sensor. The cushion pad has auxetic structure and is manufactured by a 3D printing process. The cushion pad has a slot at a side thereof. The sensor manufactured by the 3D printing process is disposed in the slot. The sensor is a pressure sensor, a humidity sensor or a temperature sensor. The pressure sensor generates a pressure signal, the humidity sensor generates a humidity signal and the temperature sensor generates a temperature signal.

10 Claims, 5 Drawing Sheets

(56) References Cited

U.S. PATENT DOCUMENTS

| | | | | |
|---|---|---|---|---|
| 2013/0044043 | A1* | 2/2013 | Abdollahi | A42B 3/0433 345/8 |
| 2013/0060168 | A1* | 3/2013 | Chu | A42B 3/046 600/595 |
| 2013/0110415 | A1* | 5/2013 | Davis | A42B 3/046 702/41 |
| 2013/0219594 | A1* | 8/2013 | Ferguson | A42B 3/121 2/413 |
| 2013/0303946 | A1* | 11/2013 | Gettens | A61B 5/11 600/587 |
| 2014/0039354 | A1* | 2/2014 | Greenwald | A61B 5/0002 600/595 |
| 2014/0068847 | A1* | 3/2014 | Kitowski | A41D 13/005 2/455 |
| 2014/0101816 | A1* | 4/2014 | Toronjo | A41D 31/0011 2/69 |
| 2015/0077246 | A1* | 3/2015 | Eppler, Jr. | A42B 3/046 340/539.12 |
| 2015/0201694 | A1* | 7/2015 | Boyce | A42B 3/046 340/539.12 |
| 2015/0374060 | A1* | 12/2015 | Morgan | A42B 1/046 2/413 |
| 2016/0113348 | A1* | 4/2016 | Twardowski, Jr. | A41D 31/005 2/412 |
| 2016/0165997 | A1* | 6/2016 | Vito | A42B 3/127 2/412 |
| 2016/0202755 | A1* | 7/2016 | Connor | A61B 5/1126 73/865.4 |
| 2016/0206033 | A1* | 7/2016 | Chan | A42B 3/0433 |
| 2016/0318255 | A1* | 11/2016 | Ou | G05B 19/4099 |
| 2017/0049164 | A1* | 2/2017 | Gruentzig | A42B 3/046 |
| 2017/0105677 | A1* | 4/2017 | Lerner | A61B 5/6803 |

* cited by examiner

GUARD PADDING WITH SENSOR AND PROTECTIVE GEAR INCLUDING THE SAME

CROSS-REFERENCE TO RELATED APPLICATION

This application claims priority from Taiwan Patent Application No. 105109091, filed on Mar. 23, 2016, in the Taiwan Intellectual Property Office, the content of which is hereby incorporated by reference in its entirety for all purposes.

BACKGROUND OF THE INVENTION

1. Field of the Invention

The present invention is related to a guard padding. More specifically, the present invention is related to the guard padding with sensor and the protective gear including the same that have self-adjusting auxetic structure and the sensor for sensing the wearing status.

2. Description of the Related Art

People who face hazardous condition e.g. intense exercise, construction site or battlefield usually wear a protective gear to protect their body from injuries. For instance, since the head contains the brain which is an important organ, a helmet is often worn to protect the head from the head injury. However, such protective gear is usually bulky and has poor ventilation, thereby causing discomfort and hindering body movement. Besides, since every person has different physique, most of the times the protective gear might not fit one person very well. As a result, the protective gear tends to cause inconvenience.

Furthermore, the body of the user carrying out activity in hazardous environment be struck by various external impacts, and the protective gear might be damaged as well. Therefore, it is necessary to design the guard padding with sensor and the protective gear that is able to adjust itself and sense the wearing status, such that the wearer feels more comfortable and has access to the sense data to determine the status of the body and the protective gear.

SUMMARY OF THE INVENTION

In light of the technical issues disclosed hereinbefore, the objective of the present invention is to provide guard padding with sensor and a protective gear including the same having auxetic structure and disposed with the sensor, in order to make the wearer more comfortable and detect the wearing status.

According to the objective, the present invention provides guard padding with sensor which includes a cushion pad and a sensor. The cushion pad has auxetic structure and is manufactured by a 3D printing process. A slot is disposed at a side of the cushion pad. The sensor is manufactured by the 3D printing process and disposed in the slot. The sensor may be a pressure sensor, a humidity sensor or a temperature sensor. The pressure sensor senses pressure and generates a pressure signal; the humidity sensor senses humidity and generates a humidity signal; the temperature sensor senses temperature and generates a temperature signal.

Preferably, the guard padding with sensor may further include a plurality of the cushion pads each having different auxetic structure, the plurality of cushion pads being disposed at different positions of a guard.

Preferably, different cushion pads may be disposed with different sensors.

Preferably, an adhesive layer may be disposed on a surface of the cushion pad; the cushion pad is attached to a guard via the adhesive layer.

According to the objective of the present invention, a protective gear is further provided. The protective gear includes a protective gear body, a cushion pad, a sensor and a processor. The cushion pad has auxetic structure and is manufactured by a 3D printing process. The cushion pad is disposed on an inner surface of the protective gear body. A slot is disposed at a side of the cushion pad corresponding to the protective gear body. The sensor manufactured by the 3D printing process is disposed in the slot. The sensor may be a pressure sensor, a humidity sensor or a temperature sensor. The pressure sensor senses pressure and generates a pressure signal, the humidity sensor senses humidity and generates a humidity signal and the temperature sensor senses temperature and generates a temperature signal. The processor is connected to the sensor to receive the pressure signal, the humidity signal or the temperature signal. The sensor and the processor are connected by a signal line. A channel corresponding to the signal line is disposed in the cushion pad and a groove corresponding to the channel is disposed in the protective gear body. The channel and the groove are linked; the signal line is disposed in the groove and the channel.

Preferably, the protective gear may further include a plurality of the cushion pads each having different auxetic structure, the plurality of cushion pads being disposed at different positions of the protective gear body.

Preferably, different cushion pads may be disposed with different sensors.

Preferably, the protective gear may further include a storage device connected to the processor. The processor transmits the received pressure signal, the received humidity signal or the received temperature signal to the storage device. The storage device stores the received pressure signal, the humidity received signal or the received temperature signal.

Preferably, the protective gear may further include a transmission device connected to the processor. The processor transmits the received pressure signal, the received humidity signal or the received temperature signal to the transmission device. The transmission device transmits the received pressure signal, the received humidity signal or the temperature received signal to an external device.

Preferably, an adhesive layer is disposed on a surface of the cushion pad; the cushion pad is attached to the protective gear body via the adhesive layer.

In conclusion, the guard padding with sensor and a protective gear including the same has self-adjusting auxetic structure providing wearer with better comfort and protection. Besides, the guard padding of the present invention is disposed with the sensor capable of sensing the wearing status to provide data related to the protective gear and the wearer.

DESCRIPTION OF THE PREFERRED EMBODIMENTS

Figure 1:
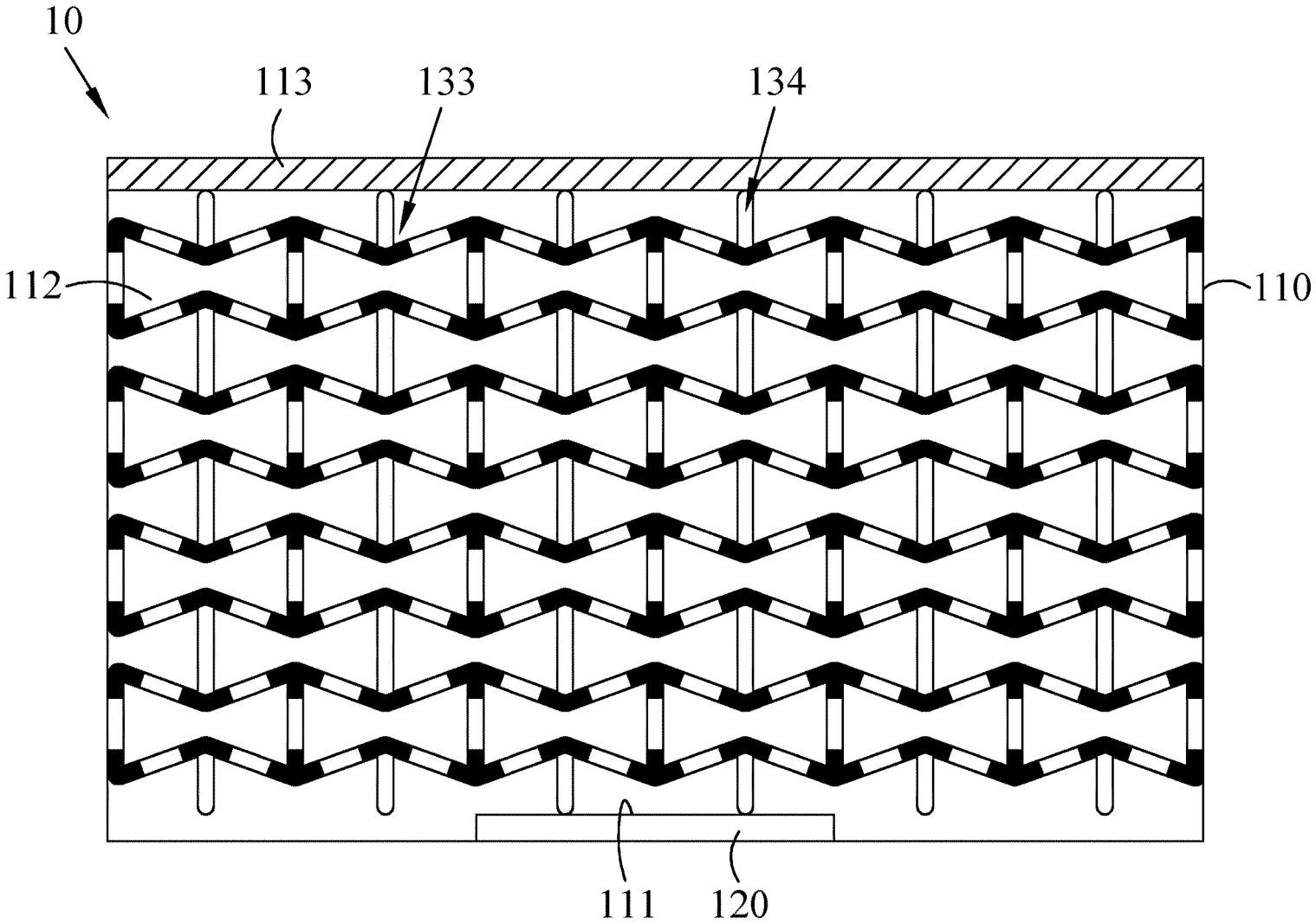
FIG. 1 is the schematic diagram illustrating the guard padding with sensor of the present invention.

Referring to FIG. 1, it is the schematic diagram illustrating the guard padding with sensor of the present invention. As can be appreciated in the figure, the guard padding with sensor 10 of the present invention may include a cushion pad 110 and a sensor 120. The cushion pad 110 having auxetic structure is manufactured via a 3D printing process. A slot 111 is disposed at one side of the cushion pad 110.

Specifically, the auxetic structure forms the bulk of the entire cushion pad 110. The auxetic structure is a structure with negative Poisson's ratio, i.e. when compressed by a force in certain direction, the auxetic structure will contract in the direction perpendicular to the applied force. On the contrary, the auxetic structure will expand in the direction perpendicular to the applied force when stretched.

In other words, when both sides of the auxetic structure are stretched, the central portion of the auxetic structure will expand and the overall volume of the structure will increase. The maximum increment of the volume may be up to 30%. Apart from that, the auxetic structure will contract and become compact when the central portion of the auxetic structure is compressed. Therefore, when the cushion pad 110 having the auxetic structure is disposed in the guard, the cushion pad 110 will change the shape thereof according to the movement of the person wearing the guard and act as buffer. Apart from that, the guard will provide a better fit to the wearer, which is attributed to the self-adjusting auxetic structure.

Besides, the auxetic structure with negative Poisson's ratio has holes 112. Therefore, the auxetic structure is able to provide better ventilation to the guard when the cushion pad 110 is disposed in the guard, thereby making the wearer more comfortable.

In addition, various characteristics such as the structural shape, size and the material of the cushion pad 110 can be designed with a computer. Therefore different cushion pads 110 can be designed to meet different requirements, for instance, the ratio of the constituent materials of the cushion pad 110 may be adjusted to meet different design requirements. The auxetic structure may have a plurality of support points including a rigid material having a first tensile strength and a plurality of nodes including an elastic material having a second tensile strength. For example, the material for the support point 133 may be the white rigid material VeroWhitePlus™ of Stratasys® which has tensile strength of approximately 50-65 MPa and elastic modulus of approximately 2000-3000 MPa. On the other hand, the material for the node 134 may be TangoBlackPlus™, which is a black rubber-like material, such material has tensile strength of approximately 0.8-1.2 MPa and hardness of 26-28 Shore A in Shore Hardness Scale.

The ratio of the materials for the support point 133 and node 134 in terms of volume may be adjusted according to the design requirement. Wherein, raising the ratio of the support point 133 (rigid material) enhances the ability of the auxetic structure to maintain the shape when a force is applied thereto; raising the ratio of the node 134 (elastic material) increases the tendency of the auxetic structure to deform when a force is applied thereto. The ratio of the support points 133 and the nodes 134 as well as the thickness of the cushion pad 110 jointly determine the overall rigidity of the cushion pad 110.

Furthermore, by adjusting the included angle at the support point 133, the limit of the volume variation of the auxetic structure may be changed. When the included angle at the support point 133 is 60°, the volume variation ranges from −49.7% i.e. the structure is compressed to 74.9% i.e. the structure is stretched. The ratio of the constituent materials and the geometric structure of the auxetic material may be adjusted during the design phase to suit different product requirements. Apart from that, the density of the structural unit of the auxetic material of the cushion pad 110 may be adjusted in order to design cushion pads 110 with varying auxetic properties.

Furthermore, the design layout is loaded into the 3D printer in order to manufacture the cushion pad 110 via the 3D printing process. Since the cushion pad 110 is printed via the 3D printing process, the production cost can be lowered and the production time can be shortened. Besides, the design of the cushion pad 110 can be instantly modified or even customized; therefore the guard padding with sensor 10 of the present invention has wide applications.

In addition, the slot 111 corresponding to the size, shape and the position of the sensor 120 may be disposed on a side of the cushion pad 110 in order to reserve an accommodation space for the sensor 120, such that after disposing the sensor 120 on the cushion pad 110, the surface of the cushion pad 110 is flat and without protrusion due to the presence of the sensor 120.

The sensor 120 may be similarly manufactured via the 3D printing process using 3D electronics printer capable of printing the temperature sensor, humidity sensor, pressure sensor, strain gauge, etc. The sensor 120 may be disposed in the corresponding slot 111 on the cushion pad 110. The thickness of the sensor 120 may be limited to the range of 0.2 to 1 mm, wherein different sensor 120 may possess different thickness. When the sensor 120 with such thickness is disposed in the slot 111 of the cushion pad 110, there will be no lumpy sensation since the wearer can hardly feel the presence of the sensor 120.

Furthermore, the sensor 120 may be the pressure sensor, humidity sensor or the temperature sensor. The pressure sensor is configured to sense the applied pressure, i.e. when the pressure sensor is installed in the cushion pad 110 of the guard, the pressure sensor is able to sense the pressure the between the body of the wearer and the cushion pad 110 and then generate the pressure signal. The humidity sensor is configured to sense the humidity, i.e. when the humidity sensor is installed in the cushion pad 110 of the guard, the humidity sensor is able to sense the humidity inside the guard and generate the humidity signal. The temperature sensor is configured to sense the temperature, i.e. when the temperature sensor is installed in the cushion pad 110 of the guard, the temperature sensor is able to sense the temperature inside the guard and generate the temperature signal.

The guard padding with sensor 10 of the present invention may further include a plurality of the cushion pads 110 each having different auxetic structure. The plurality of cushion pads 110 may be respectively disposed at different positions in the guard. In other words, a material can be classified as auxetic as long as that material has negative Poisson's ratio, so the auxetic material may possess different structures and auxetic properties. Therefore, the plurality of cushion pads 110 having varying auxetic structures may be respectively disposed at different position in the guard to cater for the corresponding requirement of that position, such that the cushion pad 110 having auxetic structure is able to achieve its full potential.

Moreover, the plurality of cushion pads 110 aforementioned may be respectively disposed with a plurality of slots 111. In particular, different sensors 120 may be respectively disposed in each slot 111 of the corresponding cushion pad 110 in order to collect corresponding information about different positions.

On the other hand, an adhesive layer 113 may be added to a surface of the cushion pad 110 while designing the cushion pad 110. Subsequently, during the 3D printing process, the necessary materials may be fed into the 3D printer in order to print the cushion pad 110 having an adhesive surface, such that the cushion pad 110 is able to directly adhere to the guard via the adhesive layer 113.

Figure 2:
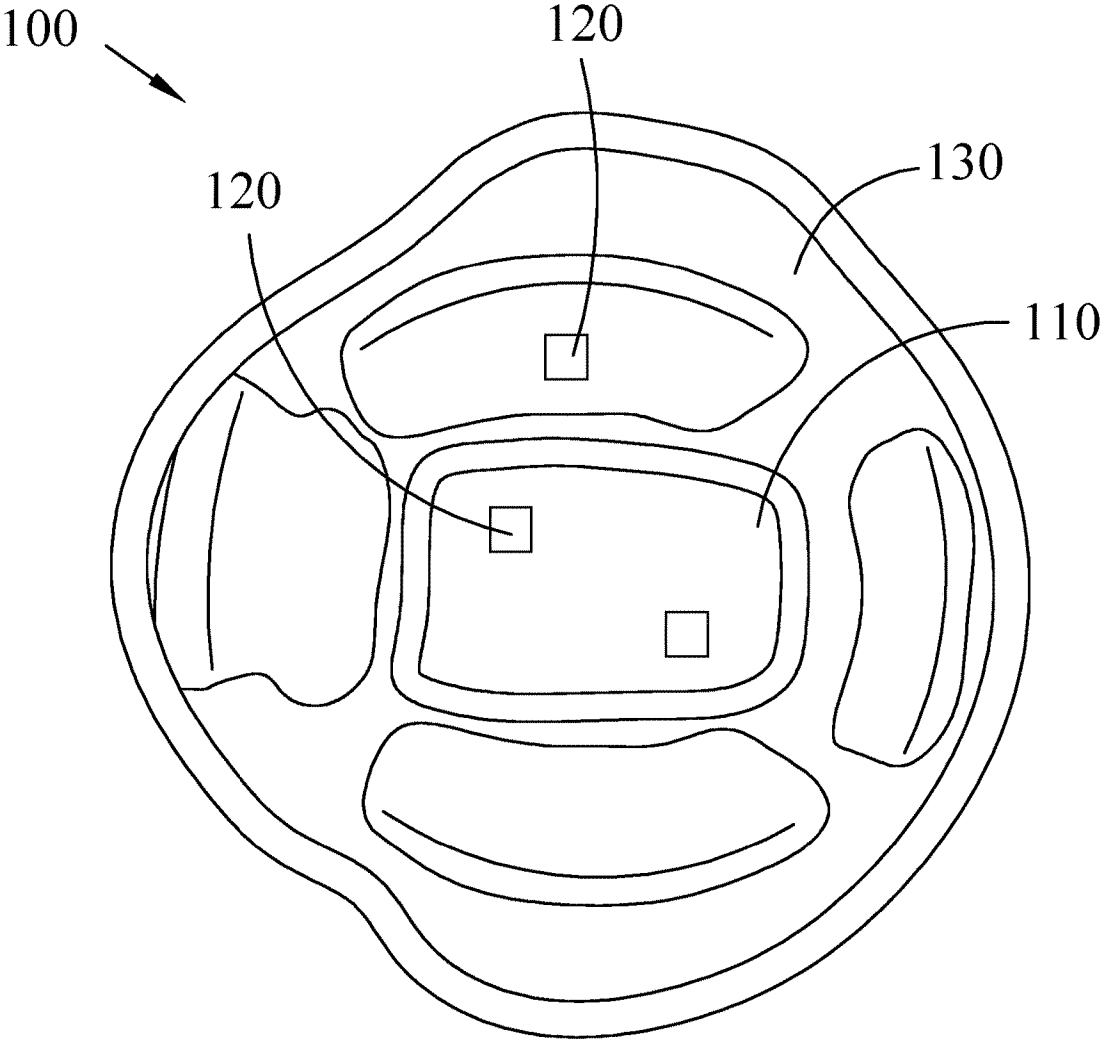
FIG. 2 is the first schematic diagram of the protective gear of the present invention.
Figure 3:
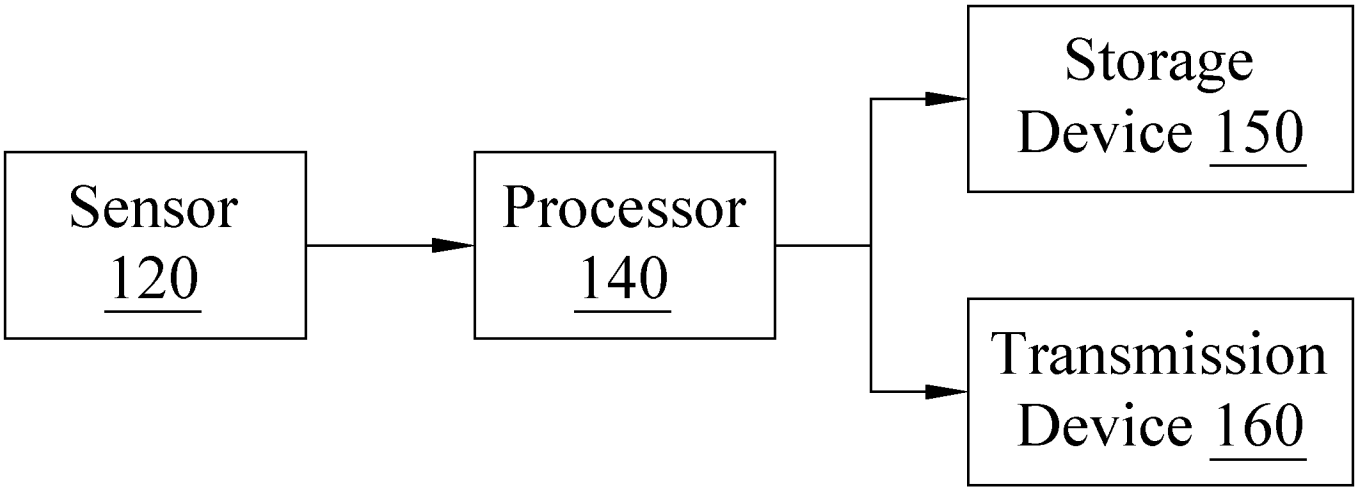
FIG. 3 is the block diagram illustrating the protective gear of the present invention.

FIG. 2 is the first schematic diagram of the protective gear of the present invention whereas FIG. 3 is the block diagram illustrating the protective gear of the present invention. As shown in the figure, the protective gear 100 of the present invention includes a protective gear body 130, a cushion pad 110, a sensor 120 and a processor 140. In simpler words, the protective gear 100 of the present invention is constructed by disposing the aforementioned guard padding with sensor 10 in the protective gear body 130. A helmet will be illustrated as the protective gear body 130 of the present invention in the context below, but the invention is not limited thereto.

The manufacturing process and structure pertaining to the cushion pad 110 have been disclosed in the paragraphs above so unnecessary details are omitted. The cushion pad 110 is disposed on the interior surface of the protective gear body 130, i.e. the interior surface of the helmet. The auxetic structure therein serves as the buffer between the head of the wearer and the helmet. Besides, the self-adjusting auxetic structure of the cushion pad 110 in the helmet provides the wearer with exceptional wearing comfort under any circumstances. Furthermore, since the auxetic structure of the cushion pad 110 has the holes 112, the protective gear 100 of the present invention is endowed with better ventilation in contrast to ordinary helmets; therefore the wearer feels no stuffy sensation and will be more comfortable.

The aforementioned slot 111 of the cushion pad 110 is situated at the side of the cushion pad 110 opposite to the protective gear body 130, i.e. the side of the cushion pad 110 coming into contact with the head of wearer directly, such that the sensor 120 therein is able to contact the head. Therefore, the sensor 120 is able to detect the status inside the helmet and generate the corresponding signal for analysis of different purpose when the wearer is wearing the helmet. Similarly, the manufacturing process, position and the types of the sensor 120 have been set forth in the context above so repetition is deemed unnecessary.

Furthermore, the protective gear 100 may include a plurality of the cushion pads 110 each having different auxetic structure and being disposed at different positions in the protective gear body 130. In other words, there are a plurality of the cushion pads 110 in the helmet and the cushion pads are disposed at different positions in the helmet, e.g. the top of the head, forehead, back of the head, both sides of the head, etc. Furthermore, the structural shape, size or material of the cushion pad 110 at different position may be modified so as to meet the corresponding requirements of that position, thereby enhancing the effectiveness of the protective gear 100 of the present invention. The cushion pad 110 may be made of various materials with different shapes. For instance the semicircular cushion pad 110 with softer material can be disposed near the forehead to distribute additional weight, i.e. when the night vision goggles or protective goggles are disposed at a position of the helmet corresponding the forehead, the semicircular structure is able to distribute the extra weight of such goggles; the rectangular cushion pad 110 which has better shock absorption capability is suitable for the position near the back of the head, so as to protect the brainstem by reducing the impact on the back of the head, e.g. absorbing the impact caused by the bullet fragments or foreign object.

Similarly, each of the plurality of cushion pads 110 may be disposed with a plurality of slots 111. Wherein different sensors 120 may be respectively disposed in the corresponding slot 111 of each cushion pad 110, in order to collect corresponding information about different positions.

Furthermore, different types of sensors 120 may be disposed in different slots 111 of the same cushion pad 110. That is to say, one cushion pad 110 may simultaneously possess the pressure sensor, humidity sensor and the temperature sensor that are distributed around different positions on the same cushion pad 110 to meet different requirements.

Meanwhile, since both the cushion pad 110 and the sensor 120 are manufactured via the 3D printing process, design features such as the structure, shape and the disposing position of the cushion pad 110 as well as the type and disposing position of the sensor 120 may be modified according to different requirements; besides the quantity and the distribution of the sensor 120 may be adjusted according to the requirements. Wherein the center of each cushion pad 110 may be disposed with at least one sensor 120 in order to reflect the overall condition around the head. The 3D printing process is able to implement customizable design as well as shorten the production time and lower the production cost.

The protective gear 100 may further include the storage device 150. The storage device 150 is connected to the processor 140. The processor 140 is configured to transmit the received pressure signal, the received humidity signal or the received temperature signal to the storage device 150 and then the storage device 150 is configured to store the received pressure signal, the received humidity signal or the received temperature signal for various purposes later on.

In addition, the protective gear 100 may further include a transmission device 160. The transmission device 160 is connected to the processor 140 such that the processor 140 is able to transmit the received pressure signal, the received humidity signal or the received temperature signal to the transmission device 160. The transmission device 160 then transmits the received pressure signal, the received humidity signal or the received temperature signal to an external device. The transmission device 160 may be connected to the external device via wireless telecommunication such that a person elsewhere has instantaneous access to the status of the user wearing the protective gear 100 of the present invention.

The aforementioned storage device 150 and the transmission device 160 are able to record the information collected by different types of sensor 120 to enable the user to carry out various analysis based on these information. For instance, the pressure sensor is able to detect the pressure on the head of the user when the helmet receives impact in order to analyze the effect of such impact on the user; besides the temperature and the humidity inside the helmet can be respectively detected by the temperature sensor and the humidity sensor in order to reflect the helmet usage status which may serve as the basis for determining user health. Moreover, a person may determine the helmet usage status according to the information collected by the sensor 120 which may serve as the indication for helmet changing.

Similarly, an adhesive layer 113 may be added to the surface of the cushion pad 110 while designing the cushion pad 110. Subsequently, during the 3D printing process, the necessary materials may be fed into the 3D printer in order to print the cushion pad 110 having an adhesive surface, such that the cushion pad 110 is able to directly adhere to the interior surface of the protective gear body 130 via the adhesive layer 113.

Figure 4:
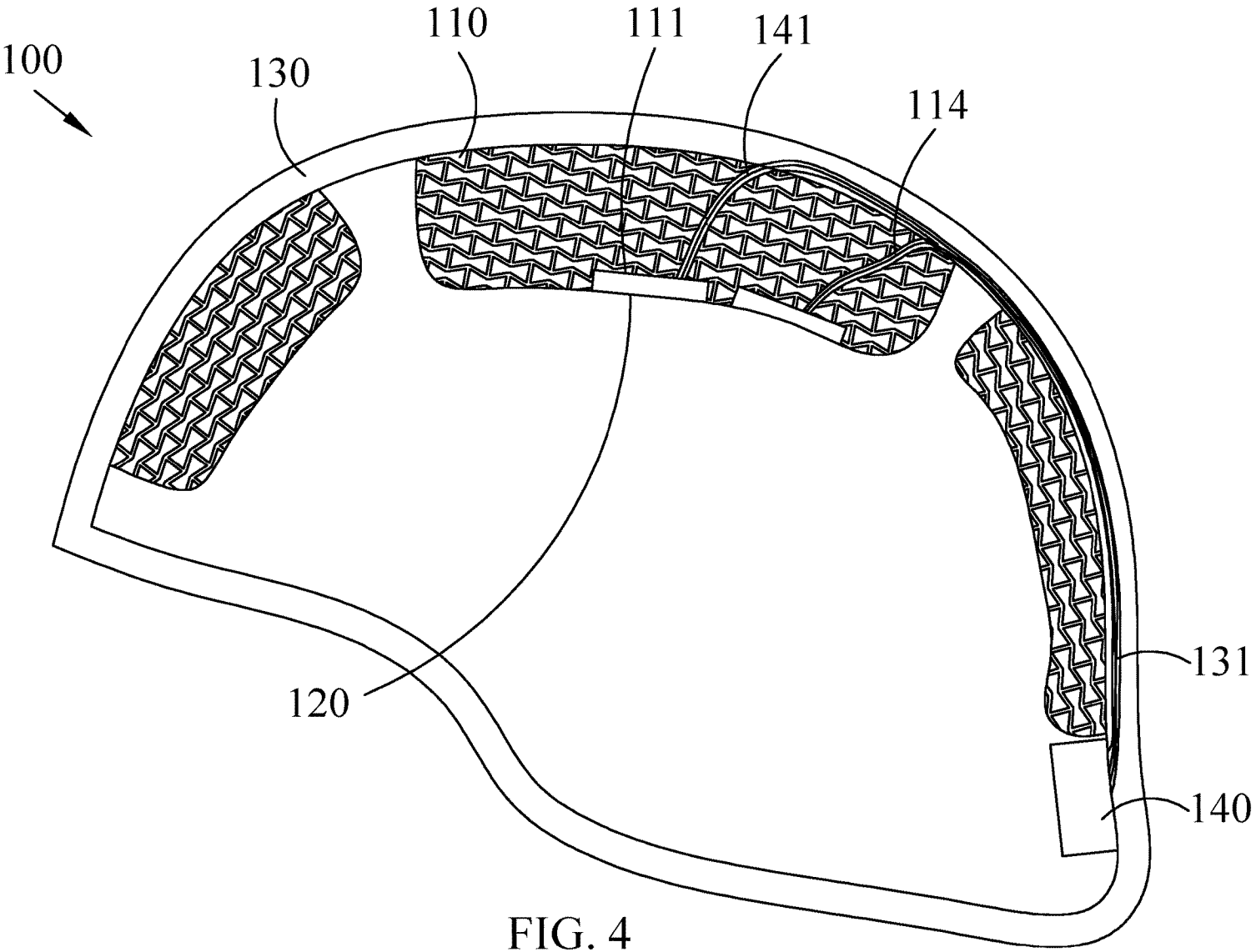
FIG. 4 is the second schematic diagram of the protective gear of the present invention.

FIG. 4 is the second schematic diagram of the protective gear of the present invention. As shown in the figure, an illustration of the connection between the sensor 120 and the processor 140 is given. Wherein, the sensor 120 and the processor 140 are connected by the signal line 141. In light of this, the channel 114 is disposed in the cushion pad 110 to accommodate the signal line 141, the channel 114 may be included in the design layout for the cushion pad 110 in advance, such that the cushion pad 110 printed by the 3D printer will possess the channel 114 which allows the signal line 141 to pass through.

The protective gear body 130 is disposed with the groove 131 corresponding to the channel 114, i.e. the helmet is disposed with the groove 131 that allows the signal line to pass through, and the channel 114 of the cushion pad 110 and the groove 131 of the helmet are interconnected, such that the signal line 141 could be disposed in the groove 131 and the channel 114. With such configuration, the signal line 141 passing through the cushion pad 110 and the helmet is able to connect the sensor 120 of the cushion pad 110 and the processor 140.

Figure 5:
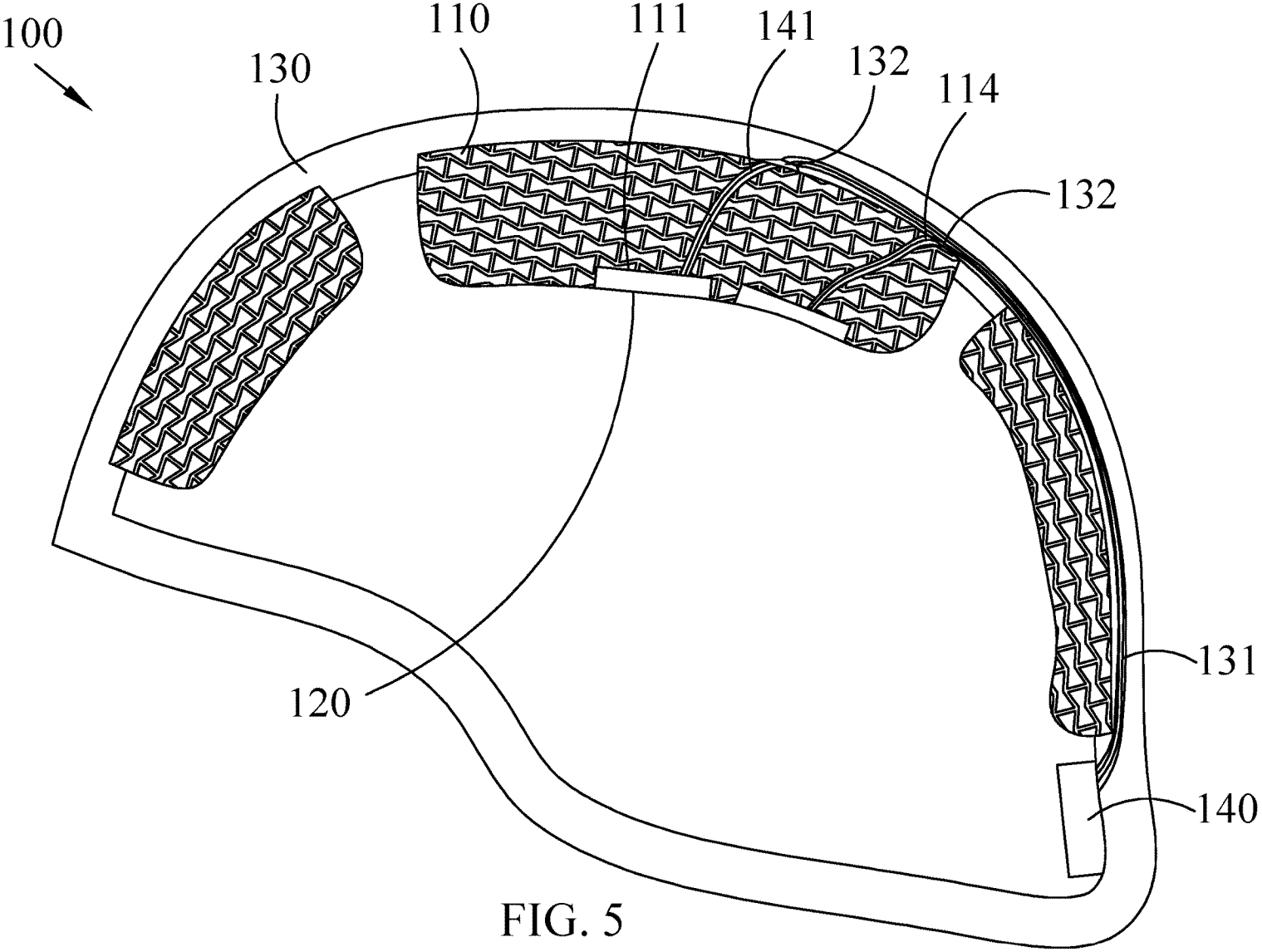
FIG. 5 is the third schematic diagram of the protective gear of the present invention.

FIG. 5 is the third schematic diagram of the protective gear of the present invention. As shown in the figure, another illustration of the connection between the sensor 120 and the processor 140 is provided. In FIG. 5, the groove 131 of the protective gear body 130 may be disposed therein, i.e. inside the helmet. Besides, the signal line 141 inside the helmet may be manufactured in conjunction with the helmet. With this configuration, when the cushion pad 110 has to be changed, the cushion pad 110 can be changed without changing the signal line 141 inside the helmet since the signal line 141 inside the groove 131 of the helmet is independent from the signal line 141 in the channel 114 of the cushion pad 110. The conducting region 132 with wide area may be disposed around the connecting point between the helmet and the signal line 141 of the cushion pad 110, such that a stable and continuous signal transmission can be established.

In conclusion, for the guard padding with sensor and the protective gear including the same of the present invention, the cushion pad having auxetic structure is disposed in the protective gear body, such that the self-adjusting auxetic structure enables the protective gear to adjust to different usage status. And the sensor disposed on the cushion pad can access to the wearing status of the protective gear.

The present invention has been described with some preferred embodiments thereof and it is understood that many changes and modifications in the described embodiments can be carried out without departing from the scope and the spirit of the invention that is intended to be limited only by the appended claims.

What is claimed is:

1. Guard padding with sensor, comprising:

a cushion pad having auxetic structure and manufactured by a 3D printing process, a slot disposed at a side of the cushion pad; and a sensor manufactured by the 3D printing process and disposed in the slot; wherein the sensor is a pressure sensor, a humidity sensor or a temperature sensor, the pressure sensor senses pressure and generates a pressure signal, the humidity sensor senses humidity and generates a humidity signal, and the temperature sensor senses temperature and generates a temperature signal, wherein the auxetic structure has a plurality of support points including a rigid material and a plurality of nodes including an elastic material, the rigid material has a first tensile strength and the elastic material has a second tensile strength which is different from the first tensile strength, wherein an included angle at each of the plurality of support points is 60°, and the volume variation of the auxetic structure is from −49.7% to 74.9%.

2. The guard padding with sensor of claim 1, further comprising a plurality of the cushion pads each having different auxetic structure, the plurality of cushion pads being disposed at different positions of a guard.

3. The guard padding with sensor of claim 2, wherein the sensor comprises a plurality of sensors and wherein different sensors of the plurality of sensors are disposed on different cushion pads of the plurality of cushion pads.

4. The guard padding with sensor of claim 1, wherein an adhesive layer is disposed on a surface of the cushion pad, the cushion pad is attached to a guard via the adhesive layer.

5. A protective gear, comprising:

a protective gear body;

a cushion pad having auxetic structure and manufactured by a 3D printing process, wherein the cushion pad is disposed on an inner surface of the protective gear body, and a slot is disposed at a side of the cushion pad corresponding to the protective gear body;

a sensor manufactured by the 3D printing process and disposed in the slot; wherein the sensor is a pressure sensor, a humidity sensor or a temperature sensor, the pressure sensor senses pressure and generates a pressure signal, the humidity sensor senses humidity and generates a humidity signal, and the temperature sensor senses temperature and generates a temperature signal; and a processor connected to the sensor to receive the pressure signal, the humidity signal or the temperature signal;

wherein, the sensor and the processor are connected by a signal line, a channel corresponding to the signal line is disposed in the cushion pad, a groove corresponding to the channel is disposed in the protective gear body, the channel and the groove are linked, and the signal line is disposed in the groove and the channel, wherein the auxetic structure has a plurality of support points including a rigid material and a plurality of nodes including an elastic material, the rigid material has a first tensile strength and the elastic material has a second tensile strength which is different from the first tensile strength, wherein an included angle at each of the plurality of support points is 60°, and the volume variation of the auxetic structure is from −49.7% to 74.9%.

6. The protective gear of claim 5, further comprising a plurality of the cushion pads each having different auxetic structure, the plurality of cushion pads being disposed at different positions of the protective gear body.

7. The protective gear of claim 6, wherein the sensor comprises a plurality of sensors and wherein different sensors of the plurality of sensors are disposed on different cushion pads of the plurality of cushion pads.

8. The protective gear of claim 5, further comprising a storage device connected to the processor, wherein the processor transmits the received pressure signal, the received humidity signal or the received temperature signal to the storage device, and the storage device stores the received pressure signal, the received humidity signal or the received temperature signal.

9. The protective gear of claim 5, further comprising a transmission device connected to the processor, wherein the processor transmits the received pressure signal, the received humidity signal or the received temperature signal to the transmission device, and the transmission device transmits the received pressure signal, the received humidity signal or the received temperature signal to an external device.

10. The protective gear of claim 5, wherein an adhesive layer is disposed on a surface of the cushion pad, and the cushion pad is attached to the protective gear body via the adhesive layer.

* * * * *